United States Patent [19]

Cadet

[11] 4,376,035

[45] Mar. 8, 1983

[54] PROCESS FOR THE SEPARATION OF SATURATED HYDROCARBONS FROM A HYDROCARBON CHARGE CONTAINING THEM

[75] Inventor: Andrè Cadet, Le Havre, France

[73] Assignee: Compagnie Francaise de Raffinage, Paris, France

[21] Appl. No.: 208,137

[22] Filed: Nov. 19, 1980

[30] Foreign Application Priority Data

Nov. 22, 1979 [FR] France ..... 79 28853

[51] Int. Cl.[3] ..... C10G 21/00; C10G 21/02

[52] U.S. Cl. ..... 208/33

[58] Field of Search ..... 208/37, 33, 31, 28

[56] References Cited

U.S. PATENT DOCUMENTS 2,342,798 2/1944 Fischer ..... 208/33

2,760,904 8/1956 Ford ..... 208/37 X 3,642,609 2/1972 Mayer et al. ..... 208/37 X 3,871,991 3/1975 Shaw ..... 208/33

*Primary Examiner*—Delbert E. Gantz

*Attorney, Agent, or Firm*—Curtis, Morris & Safford

[57] ABSTRACT

The invention relates to a process for the separation of a hydrocarbon charge into a fraction which precipitates at the operating temperature and a fraction which remains liquid at that temperature.

This process is of the incremental-dilution type and entails the use of a solvent whose composition changes at least once in the course of the various dilutions and of an antisolvent whose proportion in the solvent diminishes from at least one of the dilutions to the next dilution.

Application: Dewaxing of oils.

10 Claims, 1 Drawing Figure

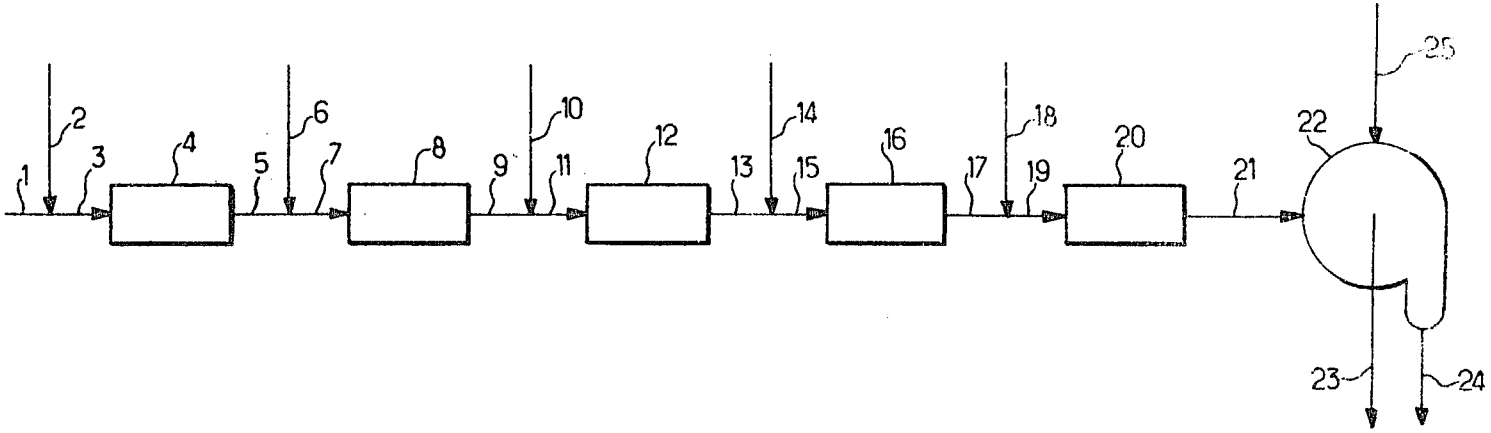
1
2
3
4
5
6
7
8
9
10
11
12
13
14
15
16
17
18
19
20
21
22
23
24
25

PROCESS FOR THE SEPARATION OF SATURATED HYDROCARBONS FROM A HYDROCARBON CHARGE CONTAINING THEM

The present invention relates to a process for the separation of at least a portion of the saturated hydrocarbons contained in a hydrocarbon charge. More particularly, it relates to a process of the type known as oil dewaxing process.

It is often necessary in industry to separate from a hydrocarbon charge at least a portion of the saturated hydrocarbons which it contains. This is the case particularly in the petroleum industry, where oil dewaxing processes serve the purpose of separating from an oil charge a saturated-hydrocarbons fraction, the wax fraction, which is in solution in the oil charge.

The dewaxed oil so obtained is sufficiently fluid in winter to be used in lubricating-oil formulations. This is not the case when the oil contains wax, which precipitates at a relatively high temperature.

An usual type of dewaxing process is the solvent dewaxing process. In this type of process, there is added to the oil charge to be dewaxed a solvent which dissolves the oil and causes the wax to precipitate, this precipitation being promoted by chilling.

The "solvent" may be composed of a single chemical compound, for example, propane. More often, however, it is composed of two chemical compounds, namely,

- a first compound which readily dissolves the oil, for example, benzene or toluene, and
- a second compound which promotes precipitation of the wax and which is known as "antisolvent".

Thus, the term "solvent" is often used in the latter sense, in the literature to say, the "solvent" may be composed at least in part of an antisolvent for wax.

To avoid confusion, hereinafter the term "solvent system" will instead be used in this latter sense. The "solvent system" when used in connection with the present invention will include an "antisolvent" component (i.e. a compound which promotes precipitation of the waxy fraction of the hydrocarbon charge) and generally also will include a "solvent component" (i.e. a solvent for the oily fraction of the hydrocarbon charge).

The solvent system may be added to the oil in several ways:

- the solvent system may be added all at once, unchilled, to the oil to be dewaxed, and the mixture may then be chilled, or
- the solvent system may be prechilled and added in several successive fractions to the oil to be dewaxed, or
- the unchilled solvent system may be added successively in several portions while the oil is being chilled.

In the last-mentioned prior-art process, known as "incremented dilution", the solvent system has a constant composition as it is being added in several portions.

The applicant has developed a method for improving the incremented dilution process.

The present invention thus seeks to improve the dewaxing of hydrocarbon charges, and especially of oils derived from crude petroleum.

Thus the present invention has a preferred embodiment a process for the separation of a hydrocarbon charge into two fractions, namely,

- a first oily hydrocarbon fraction which essentially is composed of saturated hydrocarbons and precipitates at a temperature equal to or above a given temperature, and
- a second waxy hydrocarbon fraction which remains liquid at said given temperature, said process consisting of adding to the hydrocarbon charge in at least two diluting operations, each followed by a chilling step which is separate from the diluting operation, a solvent system composed at least in part of an antisolvent for said first fraction, and in separating, after the last chilling step, said first fraction, which precipitated during the preceding operations, from said second fraction, said process being characterized in that the composition of the solvent system changes at least once in the course of the various dilutions, the proportion of antisolvent in the solvent system diminishing from at least one of the dilutions to the next dilution.

A second embodiment of the invention consists of the application of the process in accordance with the invention to the dewaxing of petroleum oils.

The process in accordance with the invention thus is characterized in that the composition of the solvent system used changes at least once in the course of two successive dilutions, the proportion of antisolvent in the solvent system diminishing from one dilution to the next. The proportion of antisolvent in the solvent system during a dilution cannot be greater than that used in a preceding dilution.

As will be shown further on with the aid of comparative practical examples, the process in accordance with the invention offers the advantage of facilitating the separation of oil and wax.

In the process in accordance with the invention, the number of dilutions, which is at least two, may vary with the hydrocarbon charge to be treated. The applicant thus has developed a process comprising five dilutions. However, there may be more or fewer dilutions.

The first dilution of the charge to be dewaxed may be carried out by two procedures:

(a) In accordance with the first procedure, the solvent system is composed in its entirety of an antisolvent for the first waxy hydrocarbon fraction. This antisolvent may be selected in particular from the group formed by ketones having from 3 to 6 carbon atoms.

(b) In accordance with the second procedure, the solvent system contains, in addition to said antisolvent, a certain proportion of a solvent component (i.e. readily dissolves the oily hydrocarbon fraction and may be a compound which is capable of dissolving the waxy hydrocarbon fraction at higher temperatures) and which may be an aromatic hydrocarbon such as benzene or toluene.

At least one of the dilutions which follow is effected with a solvent system whose composition has been modified with respect to procedures (a) and (b), respectively.

(1) When the first dilution has been effected in accordance with procedure (a), the solvent system used for at least one of the subsequent dilutions contains a certain proportion of the solvent component.

(2) When the first dilution has been effected in accordance with procedure (b), the solvent system used for at least one of the subsequent dilutions contains a proportion of the compound capable of dissolving the first hydrocarbon fraction which is greater than that in the solvent system used in the first dilution.

The applicant thus has used in the first dilution a solvent system composed entirely of methyl ethyl ketone, and in the subsequent dilutions a solvent system containing increasing proportions of toluene.

The process in accordance with the invention may be employed especially for the dewaxing of oils obtained by the refining of crude petroleum and intended for the formulation of lubricating oils.

Hydrocarbon charges which are suited for use are, more particularly, those having the following properties:

Boiling temperature at atmospheric pressure:
From 300° to 700° C.

Density at 15° C. (in conformity with French standard: NF T 60-101):
From 0.80 to 0.95.

Viscosity at 50° C., in centistokes:
From 10 to 150.

Pour point (in conformity with French standard: AFNOR T 60-105
From +10° to +70° C.

DESCRIPTION OF THE DRAWING

The accompanying drawing shows diagrammatically a dewaxing unit wherein the process in accordance with the invention may be practiced.

This dewaxing unit is supplied through pipe 1 with a charge of oil derived from petroleum which is to be dewaxed. The temperature of the charge in pipe 1 ranges from 25° to 100° C.

Through pipe 2 there is added to this charge a solvent system, which may be composed entirely of methyl ethyl ketone, for example.

The temperature of the solvent system in pipe 2 ranges from 30° to 70° C. The addition of the solvent system to the oil is effected in such a way that the volume ratio of the solvent system introduced through pipe 2 to initial charge is comprised between 0.05 and 1.

The mixture so obtained is conducted through pipe 3 to a scraped-surface exchanger 4 in which it is chilled to a temperature ranging from 15° to 60° C. To the mixture leaving the exchanger 4 through pipe 5 there is added, through pipe 6, a solvent system which may be composed of a mixture of 90 volume percent methyl ethyl ketone and 10 volume percent toluene, for example.

The temperature of the solvent system in pipe 6 ranges from 20° to 70° C. The addition of the solvent system through pipe 6 is effected in such a way that the volume ratio of the solvent system introduced through pipe 6 to initial charge is comprised between 0.1 and 0.6.

The new mixture is conducted through pipe 7 to a scraped-surface exchanger 8 in which it is chilled to a temperature ranging from 5° to 40° C.

To the mixture leaving the exchanger 8 through pipe 9 there is added, through pipe 10, a solvent system which may be composed of a mixture of 80 volume percent methyl ethyl ketone and 20 volume percent toluene, for example.

The temperature of the solvent system in pipe 10 ranges from 0° to 50° C. The addition of the solvent system through pipe 10 is effected in such a way that the volume ratio of the solvent system introduced through pipe 10 to initial charge is comprised between 0.2 and 0.7.

The new mixture is conducted through pipe 11 to a scraped-surface exchanger 12 in which it is chilled to a temperature ranging from −10° to 15° C.

To the mixture leaving the exchanger 12 through pipe 13 there is added, through pipe 14, a solvent system which may be composed of a mixture of 70 volume percent methyl ethyl ketone and 30 volume percent toluene, for example.

The temperature of the solvent system in pipe 14 ranges from 0° to −15° C. The addition of the solvent system through pipe 14 is effected in such a way that the volume ratio of the solvent system introduced through pipe 14 to initial charge is comprised between 0.4 and 1.0.

The new mixture obtained is conducted through pipe 15 to a scraped-surface exchanger 16 in which it is chilled to a temperature ranging from −5° to −20° C.

To the mixture leaving the exchanger 16 through pipe 17 there is added, through a pipe 18, a solvent system which may be composed of 30 volume percent toluene and 70 volume percent methyl ethyl ketone, for example.

The temperature of the solvent system in pipe 18 ranges from −5° to −20° C. The addition of the solvent system through pipe 18 is effected in such a way that the volume ratio of the solvent system introduced through pipe 18 to initial charge is comprised between 0.9 and 1.7.

The new mixture obtained is conducted through pipe 19 to a scraped-surface exchanger 20 in which it is chilled to a temperature ranging from −15° to −30° C.

The mixture leaving the exchanger 30 through pipe 21 is conducted to a drum-type vacuum filter 22, with which those skilled in the art are familiar.

The solvent system intended for the washing of the wax is introduced into the filter through pipe 25 at a temperature close to that of the exchanger 20.

The dewaxed oil containing most of the solvent system is discharged from the filter 22 through pipe 23.

The wax containing some of the solvent system is discharged from the filter 22 through pipe 24.

The solvent system is separated from both the dewaxed oil and the wax by separating means which are not shown, for example, by distillation.

The two examples which follow, and which are in no wise limitative, illustrate the dewaxing of two oils obtained by the refining of crude petroleum.

EXAMPLE 1

This example relates to two oil-dewaxing tests conducted in an installation similar to the one shown in the drawing described above.

These were a test A, in which the process in accordance with the invention was employed, and a control test TA, the performed for comparison, using a prior-art incremented dilution process, without changing the composition of the solvent system in the course of the various dilutions.

Tests A and TA were carried out with an oil charge to be dewaxed which was obtained by refining a crude petroleum of Iraqi origin which had the following characteristics:

| | |
|---|---|
| Density at 15° C. (in conformity with French standard NF-T 60 101): | 0.84 |
| Viscosity index (in conformity with French standard NFT 60-106): | 116 |
| Viscosity at 50° C., in centistokes: | 11.3 |

-continued

| | |
|---|---|
| Pour point (in conformity with French standard NFT 60-105): | 30° C. |
| Cloud point (in conformity with French standard NFT 60-105): | 31° C. |

The conditions of the tests TA and A are given in Table 1 which follows.

TABLE 1

| Composition of solvent system introduced through the various pipes, in volume percent | | | | | Temperature at various points in the unit (Test A or TA) | | Ratio of solvent system introduced through the various pipes (in volumes per volume of charge in pipe 1) Test A or TA | |
|---|---|---|---|---|---|---|---|---|
| Reference to drawing: | TEST TA | | TEST A | | Reference to drawing: | Temperature | | |
| Pipe | MEK* | Toluene | MEK* | Toluene | Pipe | in °C. | Pipe | Ratio |
| 2 | 75 | 25 | 100 | 0 | 1 (Charge) | 70 | 2 | 0.2 |
| 6 | 75 | 25 | 90 | 10 | 2 | 55 | | |
| | | | | | 4 | 23 | 6 | 0.2 |
| 10 | 75 | 25 | 80 | 20 | 6 | 39 | | |
| | | | | | 8 | 15 | 10 | 0.3 |
| | | | | | 10 | 20 | | |
| 14 | 75 | 25 | 70 | 30 | 12 | 2 | 14 | 0.6 |
| | | | | | 14 | −8 | | |
| 18 | 75 | 25 | 70 | 30 | 16 | −15 | 18 | 1.15 |
| | | | | | 18 | −12 | | |
| | | | | | 20 | −20 | | |
| 25 | 75 | 25 | 75 | 25 | 22 | −20 | 25 | 1 |
| | | | | | 25 | −20 | | |

*Methyl ethyl ketone

It should be noted that the tests TA and A were run under identical conditions of temperature and solvent system ratio.

The results of the tests A and TA are presented in Table 2 which follows.

TABLE 2

| | TEST TA | TEST A |
|---|---|---|
| FILTERING RATE[5] | | |
| expressed in time required, in seconds, for filtration of: | | |
| 50 $cm^3$ of oil-solvent system mixture | 12 | 12 |
| 80 $cm^3$ of oil-solvent system mixture | 26 | 26 |
| 100 $cm^3$ of oil-solvent system mixture | 40 | 40 |
| 120 $cm^3$ of oil-solvent system mixture | 54 | 55 |
| 150 $cm^3$ of oil-solvent system mixture | 80 | 81 |
| 200 $cm^3$ of oil-solvent system mixture | 138 | 140 |
| YIELD (in weight percent) | | |
| of oil | 78.8 | 80.2 |
| of crude wax[1] | 21.2 | 19.8 |
| PRODUCT QUALITY | | |
| 1. Oil | | |
| Pour point, in °C.[2] | −17 | −16 |
| Viscosity index[3] | 102 | 102 |
| 2. Crude wax | | |
| (weight percent oil)[4] | 8.3 | 4.1 |

[1]The crude wax discharged from the filter still contained some oil.
[2]In conformity with French standard NFT 60-105.
[3]In conformity with French standard NFT 60-136.
[4]In conformity with French standard NFT 60-120.
[5]For a plane filter with 30 $cm^2$ surface area operated with a pressure difference of 400 mm Hg.

It is apparent from Table 2 that with the process in accordance with the invention the oil yield is improved and the crude wax obtained contains less oil.

EXAMPLE 2

This example relates to two oil-dewaxing tests conducted in an installation similar to the one shown in the drawing described above.

These were a test B, in which the process in accordance with the invention was employed, and a control test TB, performed for comparison, using a prior-art dilution process, without changing the composition of the solvent system in the course of the various dilutions.

Tests B and TB were carried out with an oil charge to be dewaxed which was obtained by refining a crude petroleum of Iraqi origin which had the following characteristics:

| | |
|---|---|
| Density at 15° C. (in conformity with French standard NFT 60-101): | 0.87 |
| Viscosity index (in conformity with French standard NFT 60-106): | 110 |
| Viscosity at 50° C., in centistokes: | 33.5 |
| Pour point (in conformity with French standard NFT 60-105): | 45° C. |

The conditions of the tests B and TB are given in Table 3 which follows.

TABLE 3

| Composition of solvent system introduced through the various pipes in volume percent | | | | | Temperature at various points in the unit (Test B or TB) | | Ratio of solvent system introduced through the various pipes (in volumes per volume of charge in pipe 1) Test B or TB | |
|---|---|---|---|---|---|---|---|---|
| Reference to drawing: | TEST TB | | TEST B | | Reference to drawing: | Temperature | | |
| Pipe | MEK* | Toluene | MEK* | Toluene | Pipe | in °C. | Pipe | Ratio |
| 2 | 60 | 40 | 100 | 0 | 1 | 70 | 2 | 0.3 |

TABLE 3-continued

| Composition of solvent system introduced through the various pipes in volume percent | | | | | Temperature at various points in the unit (Test B or TB) | | Ratio of solvent system introduced through the various pipes (in volumes per volume of charge in pipe 1) Test B or TB | |
|---|---|---|---|---|---|---|---|---|
| Reference to drawing: | TEST TB | | TEST B | | Reference to drawing: | Temperature | | |
| Pipe | MEK* | Toluene | MEK* | Toluene | Pipe | in °C. | Pipe | Ratio |
| | | | | | (Charge) | | | |
| 6 | 60 | 40 | 90 | 10 | 2 | 55 | | |
| | | | | | 4 | 23 | 6 | 0.3 |
| 10 | 60 | 40 | 80 | 20 | 6 | 30 | | |
| | | | | | 8 | 15 | 10 | 0.4 |
| | | | | | 10 | 20 | | |
| 14 | 60 | 40 | 50 | 50 | 12 | 2 | 14 | 0.7 |
| | | | | | 14 | −8 | | |
| 18 | 60 | 40 | 50 | 50 | 16 | −15 | 18 | 1.3 |
| | | | | | 18 | −12 | | |
| 25 | 60 | 40 | 60 | 40 | 20 | −20 | 25 | 1 |
| | | | | | 22 | −20 | | |
| | | | | | 25 | −20 | | |

*Methyl ethyl ketone

The tests B and TB were run under identical conditions of temperature and solvent system ratio.

The results of the tests B and TB are presented in Table 4 which follows.

TABLE 4

| | TEST TB | TEST B |
|---|---|---|
| FILTERING RATE(5) | | |
| expressed in time required, in seconds, for filtration of: | | |
| 50 $cm^3$ of oil-solvent system mixture | 60 | 50 |
| 80 $cm^3$ of oil-solvent system mixture | 145 | 125 |
| 100 $cm^3$ of oil-solvent system mixture | 230 | 195 |
| 120 $cm^3$ of oil-solvent system mixture | 320 | 280 |
| 150 $cm^3$ of oil-solvent system mixture | 510 | 430 |
| YIELD (in weight percent) | | |
| of oil | 78.2 | 78.1 |
| of crude wax(1) | 21.8 | 21.9 |
| PRODUCT QUALITY | | |
| 1. Oil | | |
| Pour point, in °C.(2) | −13 | −12 |
| Viscosity index(3) | 97 | 97 |
| 2. Crude wax (weight percent oil)(4) | 5.8 | 5.9 |

(1)The crude wax discharged from the filter still contained some oil.
(2)In conformity with French standard NFT 60-105.
(3)In conformity with French standard NFT 60-136.
(4)In conformity with French standard NFT 60-120.
(5)For a plane filter with 30 $cm^2$ surface area operated with a pressure difference of 400 mm Hg.

It is apparent from Table 4 that with the process in accordance with the invention the filtering rate is improved.

What is claimed is:

1. A process for the separation of a hydrocarbon charge into two fractions, namely, a waxy hydrocarbon fraction essentially composed of saturated hydrocarbons, said fraction precipitating at a temperature equal to or higher than a given temperature in a given environment, and an oily hydrocarbon fraction which remains liquid at said given temperature, said process comprising adding a solvent system to the hydrocarbon charge in at least two diluting steps, following each diluting step by a chilling step which is separate from the preceding diluting step, said solvent system at all times being composed at least in part of an antisolvent for said waxy fraction, said solvent system during at least one of the dilution steps also being composed of a solvent component adapted to dissolve the oily hydrocarbon fraction, changing the composition of the solvent system at least once in the course of the various dilutions, any change in the composition of the solvent system being so as to diminish the proportion of antisolvent in the changed solvent system with respect to the composition of the solvent system in any of the preceding dilutions, and then after the last chilling step separating the precipitated waxy fraction from said oily fraction.

2. A process according to claim 1, wherein during the waxy dilution the solvent system is composed in its entirety of an antisolvent for the first hydrocarbon fraction.

3. A process according to claim 1, wherein during the first dilution the solvent system is composed of said antisolvent and of said solvent component.

4. A process according to one of claims 1, 2, or 3, wherein the antisolvent is selected from the group formed by ketones having from 3 to 6 carbon atoms.

5. A process according to one of claims 1, 2, or 3, wherein said solvent component fraction is selected from the group formed by benzene and toluene.

6. A process according to claim 4, wherein said solvent component is selected from the group formed by benzene and toluene.

7. A process according to one of claims 1, 2, or 3, wherein during the first dilution the solvent system is composed entirely of methyl ethyl ketone, and that during at least one of the subsequent dilutions the solvent system contains a certain proportion of toluene in addition to methyl ethyl ketone.

8. A process according to one of claims 1, 2, or 3, wherein said oils are obtained by the refining of crude petroleum.

9. A process according to claim 6, wherein said oils are obtained by the refining of crude petroleum.

10. A process according to claim 7, wherein said oils are obtained by the refining of crude petroleum.

* * * * *

UNITED STATES PATENT AND TRADEMARK OFFICE

CERTIFICATE OF CORRECTION

PATENT NO. : 4,376,035

DATED : March 8, 1983

INVENTOR(S) : Andre Cadet

It is certified that error appears in the above-identified patent and that said Letters Patent are hereby corrected as shown below:

Column 8, line 35 (claim 2, line 2) replace "waxy" by --first--;
line 36 (claim 2, line 3) replace "first" by --waxy--.
line 45 (claim 5, line 2) cancel "fraction".

Signed and Sealed this

Third Day of May 1983

[SEAL]

*Attest:*

GERALD J. MOSSINGHOFF

*Attesting Officer* *Commissioner of Patents and Trademarks*